US006317089B1

(12) United States Patent
Wilson et al.

(10) Patent No.: US 6,317,089 B1
(45) Date of Patent: Nov. 13, 2001

(54) HAND-HELD TRANSCEIVER ANTENNA SYSTEM

(75) Inventors: James W. Wilson, Saint George; Alan Van Buren, Cedar City, both of UT (US)

(73) Assignee: Wilson Electronics, Inc., Saint George, UT (US)

( * ) Notice: Subject to any disclaimer, the term of this patent is extended or adjusted under 35 U.S.C. 154(b) by 0 days.

(21) Appl. No.: 09/471,537

(22) Filed: Dec. 23, 1999

(51) Int. Cl.[7] ..... H01Q 1/32
(52) U.S. Cl. ..... 343/713; 343/702
(58) Field of Search ..... 343/713, 906, 343/702, 715, 725, 700 MS, 795; H01Q 1/32

(56) References Cited

U.S. PATENT DOCUMENTS

| | | | | |
|---|---|---|---|---|
| Re. 36,076 | * | 2/1999 | Bryant et al. | 343/713 |
| 3,518,681 | | 6/1970 | Kiepe | 343/702 |
| 3,702,480 | | 11/1972 | Byars | 343/715 |
| 4,740,794 | | 4/1988 | Phillips et al. | 343/702 |
| 4,931,806 | * | 6/1990 | Wunderlich | 343/715 |
| 5,357,262 | | 10/1994 | Blaese | 343/906 |
| 5,524,284 | | 6/1996 | Marcou et al. | 343/702 |
| 5,532,703 | | 7/1996 | Stephens et al. | 343/702 |
| 5,563,616 | * | 10/1996 | Dempsey et al. | 343/753 |
| 5,619,213 | | 4/1997 | Hays, III | 343/703 |
| 5,668,561 | | 9/1997 | Perrotta et al. | 343/702 |
| 5,673,053 | | 9/1997 | Marthinsson | 343/728 |
| 5,777,585 | * | 7/1998 | Tsuda et al. | 343/702 |
| 5,917,458 | * | 6/1999 | Ho et al. | 343/909 |
| 6,005,527 | * | 12/1999 | Gomez et al. | 343/713 |
| 6,025,811 | * | 2/2000 | Canora et al. | 343/793 |
| 6,031,492 | * | 2/2000 | Griffin et al. | 343/702 |

* cited by examiner

*Primary Examiner*—Don Wong
*Assistant Examiner*—Trinh Do Dinh
(74) *Attorney, Agent, or Firm*—Leon D. Rosen

(57) ABSTRACT

Apparatus is provided for coupling to a hand-held transceiver such as a cellular phone that is being operated in a radio frequency-shielded environment such as in an automobile, to transfer energy between the transceiver and an auxiliary antenna that is not shielded from the surroundings. The apparatus includes a pair of capacitor coupling elements (30, 32) that are positioned adjacent to each of the two radiating elements (40, 54) of the hand-held transceiver, and a coaxial cable (20) that connects the coupling elements to the auxiliary antenna. Each coupling element includes a sheet of electrically conductive material lying adjacent to a corresponding radiating element of the transceiver without surrounding the transceiver. A piece of releasable fastening material such as VELCRO is fixed to the transceiver, and a corresponding releasable fastening piece is fixed to the coupler that includes the coupling elements, to enable the user to quickly mount the coupling to transmit and receive from within a vehicle and to quickly disconnect for use of the transceiver outside the vehicle.

6 Claims, 3 Drawing Sheets

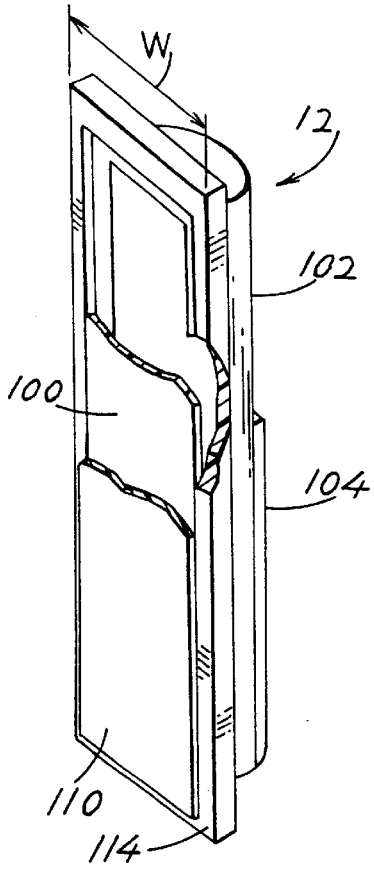
FIG. 6
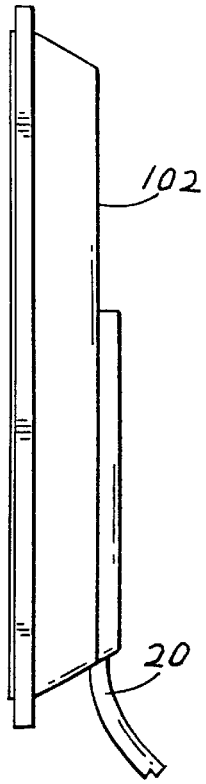
FIG. 7
FIG. 8
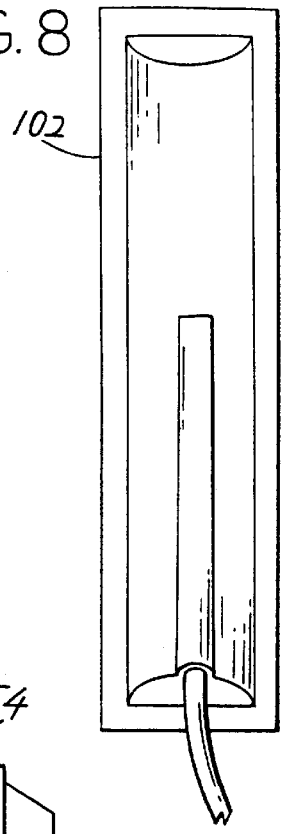
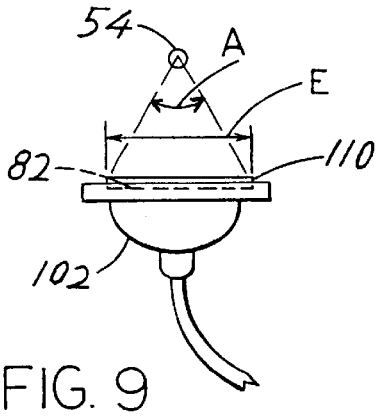
FIG. 9
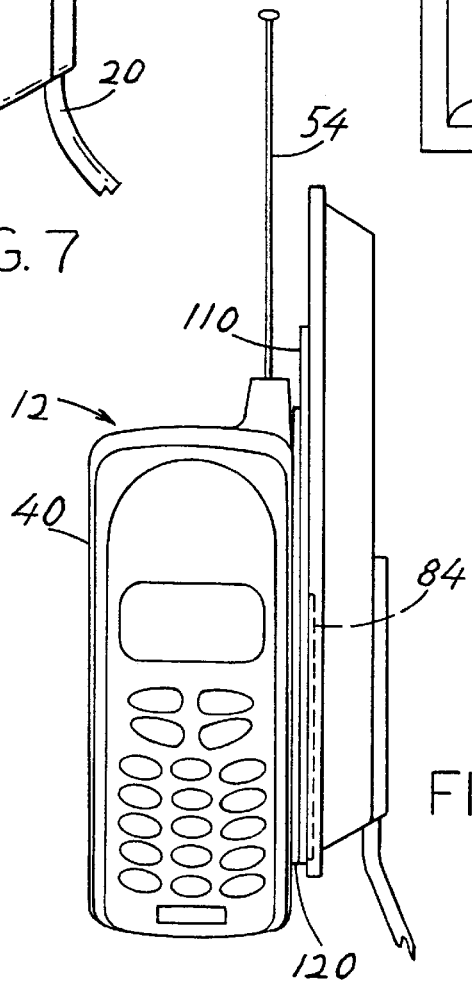
FIG. 10

HAND-HELD TRANSCEIVER ANTENNA SYSTEM

BACKGROUND OF THE INVENTION

Many hand-held personal communication transceivers in use, such as cellular and PCS phones and two-way radios, each has a relatively small attached antenna. When such hand-held transceivers are used in a radio frequency-shielded place such as the interior of an automobile, there is high attenuation of incoming and outgoing signals, resulting in poor performance. Although it would be possible to connect the transceiver to an antenna on the outside of the vehicle by plugging in a connector at the end of a cable, many hand-held transceivers have no provision for connection to external antennas.

Prior art couplers for coupling hand-held transceivers to outside antennas, have used inductive coupling to transfer radio frequency electromagnetic energy between the transceiver and a coaxial cable that extends to the antenna, without direct connection through a plug-and-socket connector. Such inductive couplers have included cradle-like holders that surround the main housing, sleeves that can be slid over the antenna, or combinations of the two, to provide coils that surround one or more radiating elements of the transceiver. Inductive coupling to the antenna only, is inefficient because it involves only a small portion of the total radiator circuit. Furthermore, the inductive coupling schemes are often cumbersome. It is noted that it is generally undesirable to provide amplifiers to amplify signals picked up by the inductor prior to transmission by the auxiliary antenna or to amplify signals picked up by the auxiliary amplifier prior to inductively coupling the signals to the transceiver, since the need to supply additional batteries or a connector to the cigarette lighter of an automobile results in increased cumbersomeness and cost. Apparatus for transferring energy between a hand-held transceiver and an auxiliary antenna, which transfer a greater proportion of the available energy than heretofore, using a coupler which minimizes restrictiveness on the use of the hand-held transceiver within the vehicle, would be of value.

SUMMARY OF THE INVENTION

In accordance with one embodiment of the present invention, a coupler is provided for transferring radio wave energy between a hand-held transceiver and a transmission line such as a coaxial cable that extends to an auxiliary antenna. The coupler transfers a high proportion of available energy in a coupler of low cost and low cumbersomeness. The coupler includes a pair of capacitive coupling elements for detecting energy transmitted by the transceiver and for transmitting energy for pick up by the transceiver. Each coupling element is positioned adjacent to a different one of the radiating elements of the hand-held transceiver, with the two conductors of a coaxial cable each connected to a different one of the coupling elements. An upper coupling element which lies adjacent to the upper radiator of the transceiver, has a lower end connected to one conductor of the cable, while the lower coupling element that lies adjacent to the lower radiator of the transceiver has an upper end connected to the other conductor of the cable. The coupling elements are preferably formed as sheets of conductive material on a dielectric substrate, with the substrate attached to one of the side walls or the rear wall of the transceiver and connected by a cable to the auxiliary antenna.

Although particular embodiments of the invention have been described illustrated herein, it is recognized that modifications and variations may occur to those skilled in the art, and consequently, it is intended that the claims be interpreted to cover such modifications and equivalents.

BRIEF DESCRIPTION OF THE DRAWINGS

FIG. 6 is a partially sectional view showing a complete coupler that uses the coupling element construction of FIG. 5.

FIG. 7 is a side elevation view of the coupler of FIG. 6.

FIG. 8 is a rear elevation view of the coupler of FIG. 6.

FIG. 9 is a top view of the coupler of FIG. 6.

FIG. 10 is a front elevation view of a hand-held transceiver, with the coupler of FIG. 6 mounted thereon.

DESCRIPTION OF THE PREFERRED EMBODIMENT

Figure 1:
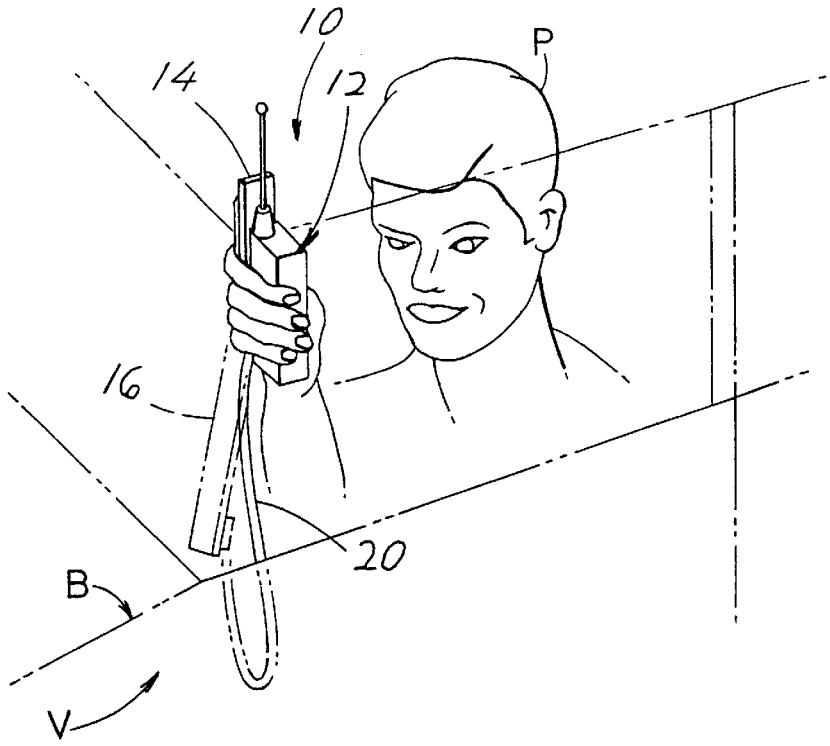
FIG. 1 is an isometric view showing a capacitive coupler mounted on a side of a hand-held transceiver, where the transceiver is held in a hand of a person who is seated in an automobile, and indicating one form of auxiliary antenna.

FIG. 1 illustrates a system 10 that can be used by a person P who is operating a hand-held transceiver 12 in an environment or area that is radio frequency-shielded from the environment. The most common example is in a vehicle such as an automobile, although some stationary structures with considerable metal in their walls also block such energy. In FIG. 1, the person P lies in a vehicle with a metal body B that blocks much of the radio waves that are transmitted by or to the transceiver 12. The system includes a coupler 14 of the present invention, that is connected to an auxiliary antenna 16 through a coaxial cable 20. The auxiliary antenna lies substantially outside the vehicle, in that it either lies outside the passenger compartment or is attached to a windshield or other glass. The use of a coupler connected by a coaxial cable to an auxiliary antenna is known in the prior art. However, in the prior art the coupler that picked up or delivered radio waves to the transceiver 12 used inductive coupling. An inductive coupler requires a coil that generally must surround a portion of the transceiver. Furthermore, such couplers provided only a weak connection to the transceiver. Radio energy transmitted between the coupler 14 and auxiliary antenna 16 is preferably not amplified, since such amplification would require additional batteries or connection to the cigarette lighter outlet of the automobile, resulting in additional cost and clumsiness, although in some cases an amplification is desirable.

Figure 2:
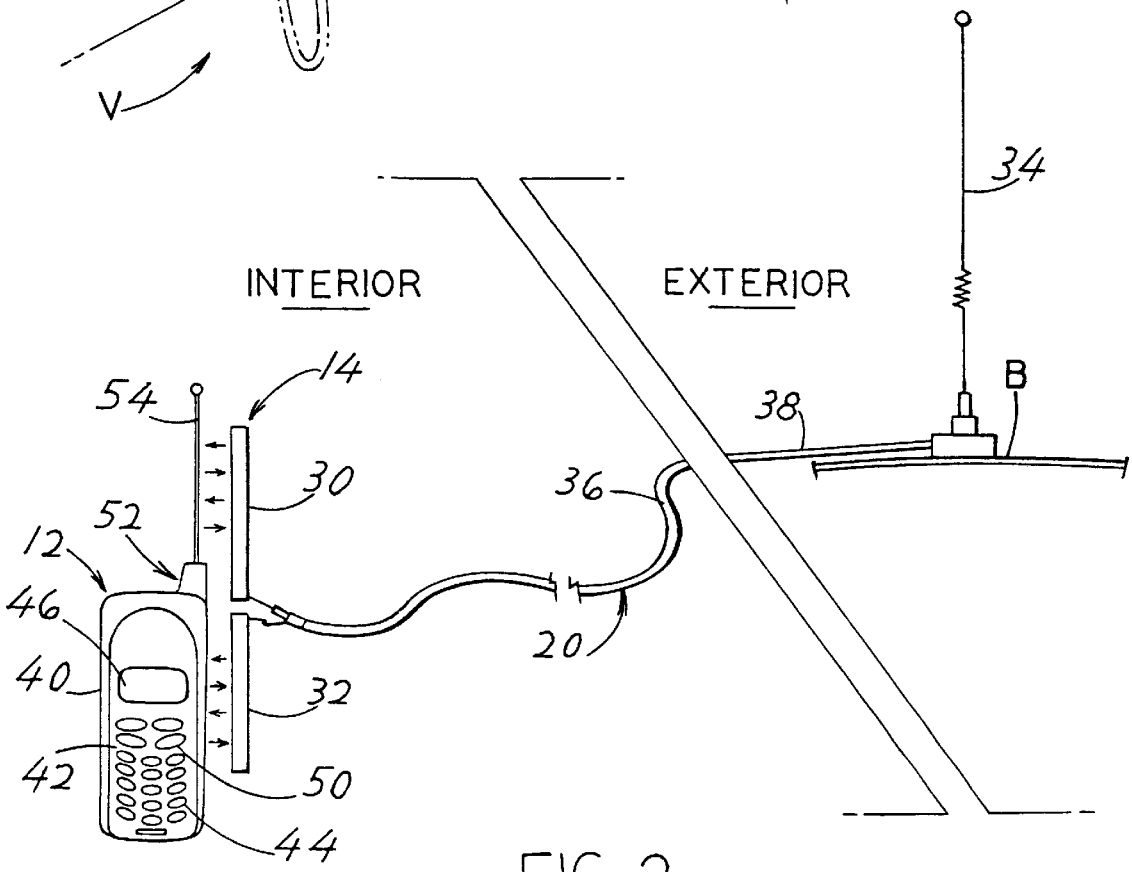
FIG. 2 is a front elevation view of the transceiver of FIG. 1 and of an antenna of another embodiment of the invention, and indicating the manner of operation of the coupler of FIG. 1.

In accordance with the present invention, the coupler 14 is a capacitive coupler. As shown in FIG. 2, the capacitive coupler includes a pair of capacitive coupling elements 30, 32 that are connected through the cable 20 to an antenna 34. FIG. 2 shows an antenna 34 that is mounted on the metal body B of the vehicle. Where necessary, the cable can include two sections 36, 38 connected by a capacitive coupler with elements on opposite sides of a window, or by other means.

The hand-held transceiver 12 includes a metal housing 40 with a front face 42 containing controls such as a keypad 44 and display 46 as well as a microphone and speaker set 50. An antenna 52 has dipole antenna elements, including the metal housing 40 (which may be covered by plastic) and which forms a lower radiator element, and an upper radiator element 54. It is possible for the housing 40 to be of dielectric material and contain a separate lower radiator element, but this is not common. In the coupler 14, coupling element 30 lies closely adjacent to the upper radiator element 54, while the lower coupling element 32 lies closely adjacent to the lower radiator element 40' formed by the metal housing.

Figure 3:
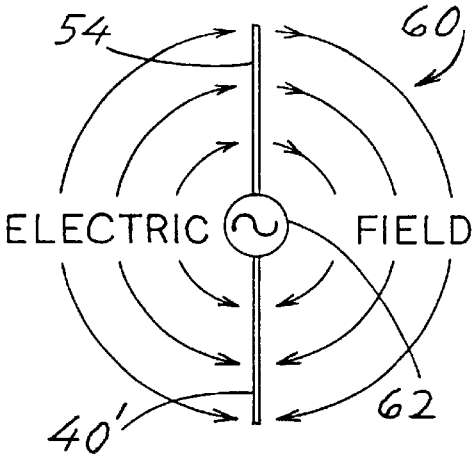
FIG. 3 is a diagrammatic view of the transceiver of FIG. 2, and showing the electric field generated when the transceiver is transmitting radio waves.
Figure 4:
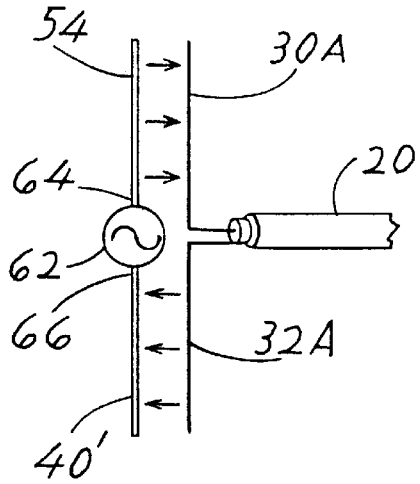
FIG. 4 is a view of a portion of FIG. 3, and also showing the manner in which the coupler of the present invention couples to the electric field produced by the radiators of the transceiver.

FIG. 3 shows the electric field 60 produced by a pair of radiator elements 54, 40', with the element 40' assumed to be stick-shaped. A generator 62 that is connected between the radiating elements, produces a high frequency carrier wave that may be modulated by voice, etc. The electric field is strongest at locations closest to the radiating elements. For maximum coupling, it is desirable to maintain a distance of less than about one-tenth and preferably one-fifteenth of a wavelength between the radiating elements and the coupling elements. As the distance from the radiating elements increases, the electric field strength progressively decreases. FIG. 4 shows the essence of applicant's coupler, which includes the pair of capacitive coupling elements 30A, 32A that lie close to the radiating elements 54, 40', with locations on the coupling elements 30A, 32A that lie closest to the ends 64, 66 of the radiating elements that are adjacent to the generator 62, being connected to the transmission line formed by the cable 20.

Cell telephones generally have a midband carrier frequency of 860 MHz (824 to 896 MHz band), while many personal communication servers have a midband carrier frequency of about 1920 MHz (1850–1990 MHz band). This corresponds to wavelengths of 0.35 m and 0.16 m, respectively. For the capacitive coupling elements to lie within one-fifteenth wavelength of the radiating elements, they must lie within 2.3 cm or 1 cm for the 860 MHz and 1920 MHz frequencies, respectively. At a distance greater than about one-tenth wavelength, the energy has decreased considerably, and applicant prefers to always keep the coupling elements within one-tenth and preferably one-fifteenth wavelength from the radiators.

Figure 5:
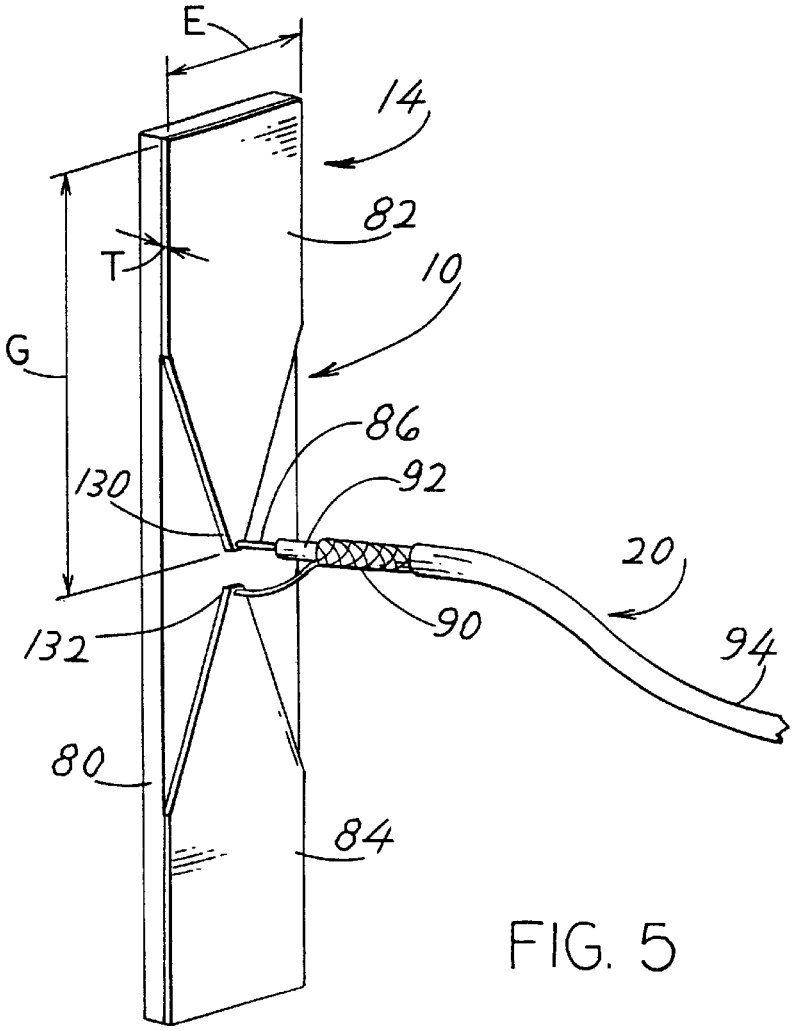
FIG. 5 is an isometric view showing the construction of the coupler of one embodiment of the invention.

FIG. 5 illustrates some details of the coupler 14 of the present invention. The coupler includes a dielectric substrate 80 which is preferably in the form of a board, and a pair of sheets 82, 84 forming the capacitive coupling elements. The board extends vertically and each sheet faces the corresponding radiator element. Each sheet can be formed by bonding a sheet of a conductive material (having a conductivity within two orders of magnitude of copper) to the board, and etching away material as shown in FIG. 5, in a manner similar to construction of circuit boards. The coaxial cable 20 has a center conductor 86 connected to one of the coupling elements 82 and an outer conductor 90 connected to the other coupling to element 84. The outer conductor 90 may be a braiding, and the cable has an inner insulator 92 separating the inner and outer conductors, and possibly with an insulative jacket 94 around the outer conductor. Connections of the cable conductors to the elements 82, 84 can be by soldering, with the jacket preferably mechanically clamped to the arrangement 100 of coupling elements 82, 84 on the substrate 80.

FIG. 6 shows the arrangement 100 mounted in a dielectric plastic coupler housing 102 that has a cable-holding part 104 to mechanically fix the position of the coaxial cable. A detachable fastener element 110 such as a strip of VELCRO is fixed to a front face 114 of the housing.

FIG. 10 shows a fastener 120 that has been permanently connected to a side of the transceiver housing, and shows the corresponding fastening element 110 of the coupler attached through the complementary fastener 120 to the housing 40 of the hand-held transceiver 12. The fastening element 110 on the coupler and the fastener 120 that is fixed to the transceiver, are preferably complementary VELCRO sheets. The VELCRO sheets are preferably not attached to the front of the housing to avoid obstructing the controls. It is possible to attach the fastener 120 to the rear of the housing, although care must then be taken to avoid obstructing any battery compartment or any control on the rear. There is usually no control or opening at a side, and the upper radiating element 54 usually lies at one side of the transceiver housing, so attachment at a side is usually preferred. At least the lower coupling element 84 has a height that is at least half the height of the lower radiating element formed by the metal housing 40. Applicant prefers to use a coupler 12 having a width W (FIG. 6) no more than twice the width of the transceiver. Common transceivers have a width of about one inch, so applicant refers to use a coupler having a width of no more than two inches, and preferably no more than about one inch, to minimize obstruction to use of the hand-held transceiver. As indicated in FIGS. 5 and 6, the coupling elements 82, 84 extend along substantially the entire width of a coupler, so coupling elements of maximum width are provided to generate maximum electric fields and to produce maximum voltages for a given electric field.

FIG. 5 shows that the upper coupling element 82 has a lower end 130 that is connected to the coaxial cable, while the lower coupling element has an upper end 132 that is connected to the coaxial cable, which is the manner in which a feed line should be connected to radiators. The ends of the elements are tapered, so the lower end 130 of the upper element is of progressively greater width at progressively greater locations, and the upper end 132 of the lower element is of progressively greater width at progressively lower locations.

It is desirable to form each sheet-like coupling element 82, 84 with a large area adjacent to a corresponding radiating element, in order to intercept more energy from the electric field. It is desirable that the width W of the coupling element extend by an angle A (FIG. 9) of at least 60° of the corresponding coupling element 54. The closer the coupling element lies to the radiating element, the greater the angle.

In a coupler that applicant has designed, of the type shown in FIG. 5 for both 850 MHz and 1850 MHz, the coupling elements each had a width E of 2 cm and a height G of 8 cm. The elements were formed of copper at about 0.02 mm thickness.

Thus, the invention provides a coupler for coupling a hand-held transceiver to an auxiliary antenna, where the coupler transfers a high proportion of radio wave energy between itself and the transceiver in a construction that minimizes interference with use of the transceiver. The coupler includes first and second capacitive coupling elements that are mounted on a coupler housing for positioning the elements adjacent to first and second radiating elements of the transceiver. A transmission line formed by a coaxial cable for coupling to the auxiliary antenna, has inner and outer coaxial conductors, one connected to the first coupling element and the other connected to the second coupling element. Each of the coupling elements is preferably formed by a sheet of highly conductive material and lies adjacent to a corresponding radiating element of the transceiver, within a distance of no more than one-tenth wavelength of the carrier wave transmitted to and from the transceiver, and preferably within one-fifteenth of a wavelength. The coupling elements are vertically spaced apart, and have adjacent ends connected to the inner and outer conductors of a coaxial cable. The adjacent ends are preferably tapered to minimize coupling of the elements to each other. The coupler is preferably detachably mounted to a side of the transceiver, by fixing a detachable fastener to the transceiver housing and fixing a corresponding detachable fastener to the coupler.

What is claimed is:

1. A hand-held transceiver that has first and second radiating elements, and apparatus that is unpowered for transferring energy between said transceiver and an auxiliary antenna, comprising:

a capacitive coupler comprising upper and lower capacitive coupling elements lying adjacent, respectively, to said first and second radiating elements to capacitively couple to said radiating elements;

a coaxial cable for coupling said coupler to said auxiliary antenna, said coaxial cable having inner and outer coax conductors with one coax conductor connected to said first coupling element and the other coax conductor coupled to said second coupling element;

said upper coupling element has a primarily rectangular upper part and has a tapered lower end that is of progressively greater horizontal width at progressively higher locations therealong, and said lower coupling element has a primarily rectangular lower part and has a tapered upper end that is of progressively greater horizontal width at progressively lower locations therealong, with said coax conductors connected one to the lower end of said upper coupling element and the other to the upper end of said lower coupling element.

2. In a vehicle that includes a primarily metal body, an auxiliary antenna mounted substantially on the outside of the vehicle, and a hand-held transceiver located inside the vehicle, where the transceiver includes a metal housing forming a lower radiator element and a rod-like member extending up from said housing and forming an upper radiating element, with at least the upper radiating element having a height that is a plurality of times greater than its horizontal width, an improvement comprising:

a capacitive coupler that includes upper and lower electrically conductive coupling elements, said coupler being detachably connected to said hand-held transceiver with said upper and lower coupling elements lying adjacent to said upper and lower radiating elements, respectively;

a transmission line connecting said coupling elements to said auxiliary antenna;

each of said coupling elements includes electrically conductive material having a width and having a height that is more than twice said width.

3. The improvement described in claim 2 wherein:

said capacitive coupler includes a dielectric substrate and upper and lower sheets of electrically conductive material that are mounted on said substrate with said upper sheet lying at a higher level than said lower sheet, with each sheet forming one of said coupling elements and with each sheet facing one of said radiating elements, with said upper sheet having upper and lower ends and said lower sheet having upper and lower ends;

said upper end of said upper sheet is of rectangular shape and said lower end of said upper sheet is tapered in width to be progressively wider at progressively higher locations, and said lower end of said lower sheet is of rectangular shape and said upper end of said lower sheet is tapered in width to be progressively wider at progressively lower locations.

4. The improvement described in claim 2 wherein:

said radiating elements each is elongated and extends primarily vertically;

at least said lower coupling element extends along a height that is greater than half the height of said body.

5. The improvement described in claim 2 wherein:

said transceiver is constructed to transmit at a predetermined frequency, and each of said coupling elements is spaced from a corresponding radiating element by no more than one-tenth of the wavelength of said predetermined frequency.

6. The improvement described in claim 5 wherein:

said coupling elements each has a surface facing a corresponding radiating element, with the width of the surface of a first of said coupling elements subtending an angle A of at least 60° around the corresponding radiating element.

* * * * *